US011371691B2

(12) United States Patent
On

(10) Patent No.: US 11,371,691 B2
(45) Date of Patent: Jun. 28, 2022

(54) WATERPROOF DECORATIVE LAMP

(71) Applicant: Lamues Light Enterprise Co., Ltd., Dongguan (CN)

(72) Inventor: Chow Kwok On, Tai Po (CN)

(73) Assignee: DONGGUAN KAILANG INDUSTRIAL CO., LTD., Dongguan (CN)

( * ) Notice: Subject to any disclaimer, the term of this patent is extended or adjusted under 35 U.S.C. 154(b) by 0 days.

(21) Appl. No.: 16/742,379

(22) Filed: Jan. 14, 2020

(65) Prior Publication Data

US 2020/0232636 A1 Jul. 23, 2020

(30) Foreign Application Priority Data

Jan. 18, 2019 (CN) ..... 201910051551.3
Jan. 18, 2019 (CN) ..... 201920090241.8

(51) Int. Cl.
*F21V 31/00* (2006.01)
*F21V 23/00* (2015.01)
(Continued)

(52) U.S. Cl.
CPC ..... *F21V 31/005* (2013.01); *F21V 15/01* (2013.01); *F21V 17/164* (2013.01);
(Continued)

(58) Field of Classification Search
CPC ..... F21V 31/005; F21V 15/01; F21V 17/164; F21V 23/002; F21V 19/0005; F21S 4/10
See application file for complete search history.

(56) References Cited

U.S. PATENT DOCUMENTS 4,244,014 A 1/1981 Van ess
5,001,615 A * 3/1991 Stefanelli ..... F21V 19/0005 362/655
(Continued)

FOREIGN PATENT DOCUMENTS

CN 1624378 A 6/2005
CN 2919011 Y 7/2007
(Continued)

OTHER PUBLICATIONS

Chinese Patent Office Action for Application No. 201910051551.3 dated Mar. 4, 2020 (10 pages, English translation included).
(Continued)

*Primary Examiner* — Rajarshi Chakraborty
*Assistant Examiner* — Michael Chiang
(74) *Attorney, Agent, or Firm* — Michael Best & Friedrich LLP

(57) ABSTRACT

A waterproof decorative lamp includes an illuminating body having a first end, a second end opposite the first end, and an outer wall extending between the first end and the second end, a plurality of wires connected to the first end of the illuminating body, an isolation fixing column clamped between the plurality of wires, and a housing coupled to the isolation fixing column, the housing having an inner wall defining an inner cavity. The housing is installed from the second end of the illuminating body, the housing sheaths a periphery of the isolation fixing column and a periphery of first end of the illuminating body close to the wires, the second end of the illuminating body is exposed from the housing, the inner wall of the housing abuts against the outer wall of the illuminating body, and the wires are clamped between the isolation fixing column and the inner wall.

12 Claims, 4 Drawing Sheets

(51) Int. Cl.

| | |
|---|---|
| ***F21V 15/01*** | (2006.01) |
| ***F21V 17/16*** | (2006.01) |
| ***F21V 19/00*** | (2006.01) |
| ***H01R 13/46*** | (2006.01) |

(52) U.S. Cl.
CPC ..... *F21V 19/0005* (2013.01); *F21V 23/002* (2013.01); *H01R 13/46* (2013.01)

(56) References Cited

U.S. PATENT DOCUMENTS

| | | | | |
|---|---|---|---|---|
| 5,685,638 | A | 11/1997 | Huang | |
| 5,709,457 | A * | 1/1998 | Hara | F21V 19/0005 362/249.01 |
| 6,250,782 | B1 | 6/2001 | Huang | |
| 6,416,203 | B1 * | 7/2002 | Fan Wong | F21V 19/0005 362/267 |
| 6,719,441 | B2 | 4/2004 | Wong | |
| 6,921,180 | B2 | 7/2005 | Huang | |
| 8,388,213 | B2 | 3/2013 | Yu | |
| 9,803,851 | B2 | 10/2017 | Loomis et al. | |
| 10,584,865 | B2 | 3/2020 | Loomis et al. | |
| 2004/0017684 | A1 * | 1/2004 | Huang | F21V 31/005 362/267 |
| 2006/0062020 | A1 * | 3/2006 | Kuo | F21S 4/10 362/654 |
| 2008/0143234 | A1 * | 6/2008 | Yu | F21S 4/10 313/318.08 |
| 2009/0251923 | A1 | 10/2009 | Yu | |
| 2009/0318027 | A1 * | 12/2009 | Tseng | F21V 15/01 439/619 |
| 2010/0254161 | A1 * | 10/2010 | Liu | F21V 19/0005 362/654 |
| 2011/0122613 | A1 | 5/2011 | Hsu | |
| 2011/0221343 | A1 | 9/2011 | Kuo | |
| 2012/0033439 | A1 * | 2/2012 | Liu | F21S 4/10 362/457 |
| 2012/0113654 | A1 | 5/2012 | Dai | |
| 2013/0003390 | A1 * | 1/2013 | Wu | F21S 4/10 362/311.02 |
| 2013/0322087 | A1 * | 12/2013 | Tseng | F21V 19/0025 362/311.02 |
| 2015/0204524 | A1 | 7/2015 | Pan | |
| 2015/0211727 | A1 * | 7/2015 | Loomis | F21V 3/02 362/311.02 |
| 2020/0224867 | A1 | 7/2020 | Loomis et al. | |

FOREIGN PATENT DOCUMENTS

| | | | |
|---|---|---|---|
| CN | 101055064 | A | 10/2007 |
| CN | 201246726 | Y | 5/2009 |
| CN | 201335326 | Y | 10/2009 |
| CN | 101655227 | A | 2/2010 |
| CN | 202091877 | U | 12/2011 |
| CN | 109915791 | A | 6/2019 |
| CN | 209295040 | U | 8/2019 |

OTHER PUBLICATIONS

United States Patent Office Action for U.S. Appl. No. 16/864,935 dated Nov. 20, 2020 (9 pages).
United States Patent Office Action for U.S. Appl. No. 16/864,930 dated Jan. 1, 2021 (10 pages).
Chinese Patent Office Action for Application No. 201910051551.3 dated Jul. 10, 2020 (6 pages, statement of relevance included).
Chinese Patent Office Action for Application No. 201910051551.3 dated Oct. 21, 2020 (5 pages, statement of relevance included).
Chinese Patent Office Supplemental Search Report for Application No. 201910051551.3 dated Apr. 6, 2021 (1 page).
Chinese Patent Office Supplemental Search Report for Application No. 201910875178.3 dated Jul. 19, 2020 (1 page).
Chinese Patent Office Supplemental Search Report for Application No. 201910875470.5 dated Apr. 16, 2020 (1 page).
Chinese Patent Office Action for Application No. 201910875470.5 dated Apr. 26, 2020 (5 pages, statement of relevance included).
Chinese Patent Office Action for Application No. 201910875470.5 dated Sep. 9, 2020 (4 pages, statement of relevance included).

* cited by examiner

WATERPROOF DECORATIVE LAMP

CROSS-REFERENCE TO RELATED APPLICATIONS

This application claims priority to Chinese Patent Application No. 201910051551.3, filed Jan. 18, 2019, and to Chinese Utility Model Application No. 201920090241.8, filed Jan. 18, 2019, the entire contents of both of which are incorporated herein by reference.

FIELD OF THE INVENTION

The invention relates to a technical field of decorative lamps and, in particular, to a waterproof decorative lamp.

BACKGROUND

The existing traditional decorative lamp generally includes an illuminating body, wires and a lamp holder, and for beauty, a lamp cover is generally disposed on the illuminating body for decoration.

One kind of structure of the existing decorative lamp apparatus is of a contact type, where the illuminating body sheaths the end of the lamp holder and is fixed, a power source is located in the lamp holder, and light is given out by the illuminating body contacting the power source. However, the above-mentioned structure, in which there is a gap between the illuminating body and the lamp holder, has no waterproof function, so water easily enters from the gap between the illuminating body and the lamp holder, resulting in poor contact and failure.

Another kind of structure provides a certain waterproof effect by disposing a housing and making the upper end of the housing abut against the lower end of the illuminating body. However, the applicant finds that the decorative lamp of the above-mentioned structure has at least the following technical problems.

First, since the illuminating body, e.g., a light emitting diode, is required to be provided with pins at the bottom thereof in the production process and due to the limitation of the production process, the illuminating body cannot be completely flattened, and the above-mentioned manner of only making the housing or another waterproof means abut against the bottom end of the illuminating body has a comparatively poor waterproof effect.

Second, when the above-mentioned decorative lamp is assembled, it is required to firstly make the wires pass through the interior of the housing by means of through holes in an isolation means, and then make the housing abut against the bottom of the illuminating body, in which manner it is required that the wires pass through the entire housing, and when the diameter of the isolation means between the wires is larger than that of the illuminating body, the structure cannot make the housing closely cooperate with the illuminating body, and thus lose the waterproof function, so other waterproof manners must be adopted to make the structure waterproof, thereby resulting in the increase of the material cost and production cost.

Third, in the above-mentioned installation manner, the housing abuts against the illuminating body from the rear of the illuminating body, so it is inevitable that the wires are firstly sheathed by the housing, and then the illuminating body is processed onto the wires, the traditional decorative lamp processing manners for many years are to make the housing abut against the illuminating body from the rear of the illuminating body, and just due to the prohibition of the above-mentioned traditional mode, producers have been unable to achieve the integration of the illuminating body and the wires, which are then sheathed by the housing, so the above-mentioned structure results in a comparatively low production efficiency of decorative lamps, and can hardly achieve automated production.

Accordingly, a need exists for a decorative lamp that solves one or more of the above-mentioned problems.

SUMMARY

The invention provides, in one aspect, a waterproof decorative lamp to solve a technical problem of a poor waterproof effect of decorative lamps existing in the prior art. Many technical effects that can be produced by preferred technical solutions among many technical solutions provided by the invention are stated in detail below.

The invention provides, in another aspect, a waterproof decorative lamp including an illuminating body having a first end, a second end opposite the first end, and an outer wall extending between the first end and the second end, a plurality of wires connected to the first end of the illuminating body, an isolation fixing column clamped between the plurality of wires, and a housing coupled to the isolation fixing column, the housing having an inner wall defining an inner cavity. The housing is installed from the second end of the illuminating body, the housing sheaths a periphery of the isolation fixing column and a periphery of first end of the illuminating body close to the wires, the second end of the illuminating body is exposed from the housing, the inner wall of the housing abuts against the outer wall of the illuminating body, and the plurality of wires is clamped between the isolation fixing column and the inner wall of the housing.

The invention provides, in another aspect, a waterproof decorative lamp including an illuminating body having a first end and a second end opposite the first end, first and second wires coupled to the first end of the illuminating body, an isolation fixing column disposed adjacent the first end of the illuminating body, the isolating fixing column including a first groove receiving the first wire, a second groove receiving the second wire, and a buckle block projecting from a side of the isolation fixing column, and a housing enclosing the first end of the illuminating body and at least a portion of the isolation fixing column, the housing including an installation hole configured to receive the buckle block to couple the housing to the isolation fixing column. The first wire and the second wire are clamped between the housing and the isolation fixing column, and the second end of the illuminating body extends beyond the housing.

Waterproof decorative lamps embodying aspects of the present invention may have the following beneficial effects:

First, the housing performs sheathing from the front end of the illuminating body. The inner wall of the housing abuts against the outer wall of a portion of the illuminating body, and the outer wall of the illuminating body is generally arranged according to specifications, and is comparatively smooth. The inner wall of the housing is fastened to the outer wall of the isolation fixing column. The combination of the above-mentioned structures can greatly improve the waterproof effect.

Second, the above-mentioned front-to-rear installation manner of the housing makes it possible that the housing is installed after the illuminating body is directly connected with the wires and the like, while the traditional installation manner of achieving waterproofing by making the housing abut against the rear end of the illuminating body can only firstly make the housing sheath the wires and then install the illuminating body, which has a low production efficiency and can hardly achieve automated production. The above-mentioned structure and installation manner in which the housing performs sheathing from the front end of the illuminating body can improve the production efficiency and facilitate the achievement of the automated production.

Third, the wires do not need to pass through the entire housing by means of the through holes in the housing. Embodiments according to the present invention are not subject to the number and size of the wires and can improve the waterproof reliability and reduce the production cost by fastening the outer wall of the isolation fixing column to the inner wall of the housing.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

It should be understood that orientations or positional relationships indicated by the terms "center", "length", "width", "height", "upper", "lower", "front", "rear", "left", "right", "vertical", "horizontal", "top", "bottom", "inside", "outside", "side", etc. are based on orientations or positional relationships shown in the figures, and are only used to facilitate the descriptions of the invention and simplify the descriptions, rather than indicate or suggest that the devices or elements referred to must have specific orientations and be constructed and operated in the specific orientations.

DETAILED DESCRIPTION

Figure 1:
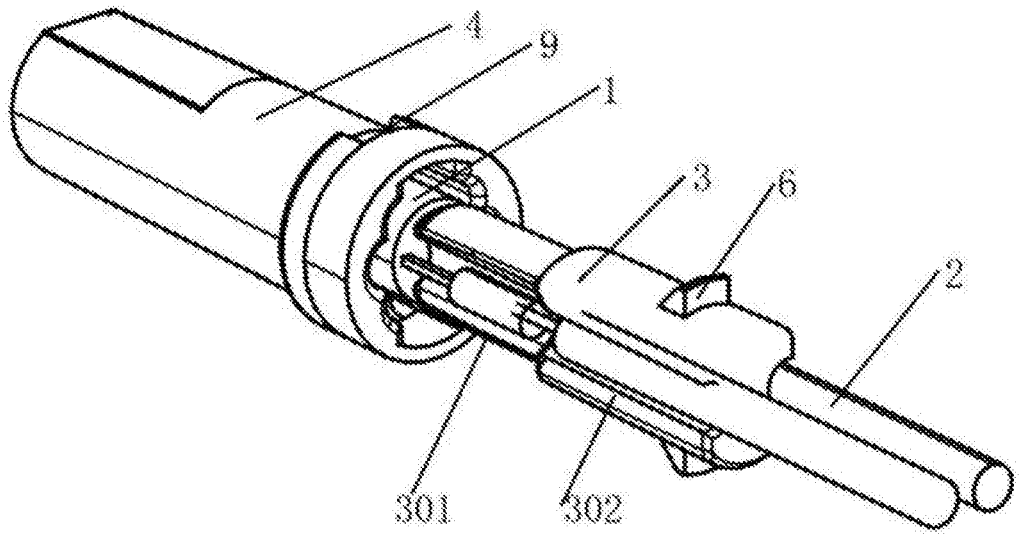
FIG. 1 is a perspective view of a combined structure of a waterproof decorative lamp.
Figure 2:
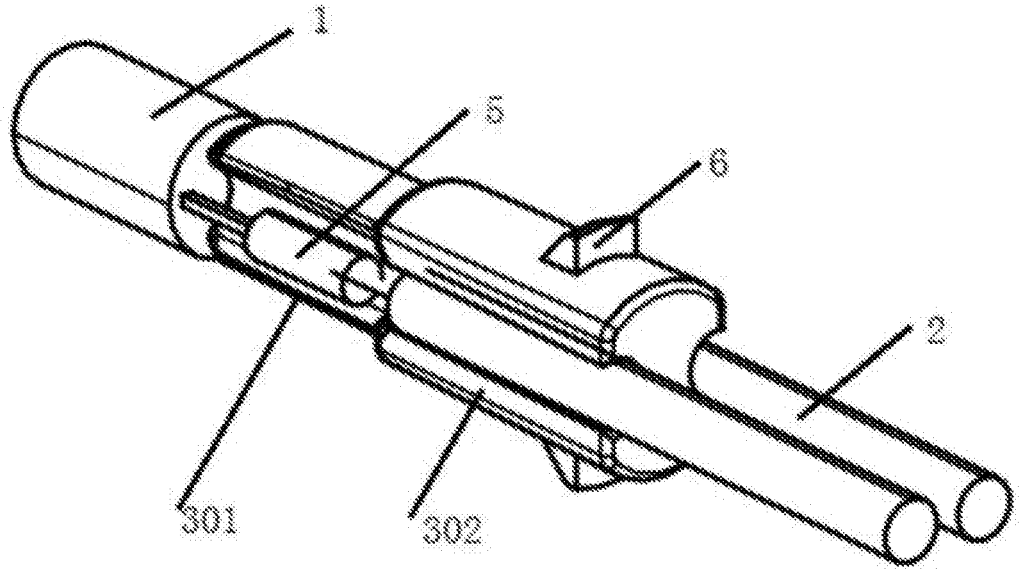
FIG. 2 is a perspective view of installation of an isolation fixing column in cooperation with an illuminating body and wires.
Figure 3:
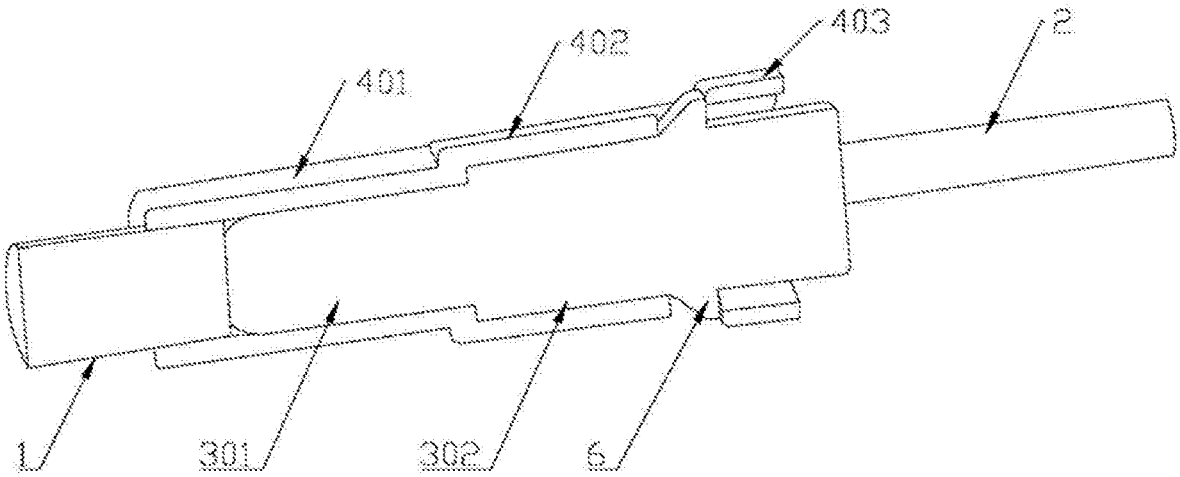
FIG. 3 is a cross-sectional view of the combined structure of the waterproof decorative lamp.

FIG. 1 is a schematic view of a combined structure of a waterproof decorative lamp, FIG. 2 is a schematic view of installation of an isolation fixing column in cooperation with an illuminating body and wires, and FIG. 3 is a cross-sectional view of the combined structure of the waterproof decorative lamp.

Referring to FIGS. 1-2, the illustrated waterproof decorative lamp includes: an illuminating body 1, and wires 2 connected with the illuminating body 1; an isolation fixing column 3, which is clamped between the wires 2; and a housing 4 (FIG. 1), which has a cavity structure inside. The housing 4 is installed from one end of the illuminating body 1, and sheaths the periphery of the isolation fixing column 3 and the periphery of one end of the illuminating body 1 close to the wires 2. The other end of the illuminating body 1 is exposed from the housing 4. The inner wall of the housing 4 abuts against the outer wall of one end of the illuminating body 1, and the isolation fixing column 3 is engaged and fixed with the housing 4. The outer wall of the isolation fixing column 3 and the inner wall of the housing 4 can fasten the wires 2.

Since the illuminating body 1 is generally produced according to specifications, the outer wall thereof is smooth, but the bottom cannot be flattened due to the provision of pins. In existing waterproof decorative lamps, the housing 4 abuts against the bottom of the illuminating body 1, or the housing 4 abuts against the bottom of the illuminating body 1 in cooperation with a connection means, and the above-mentioned structure has a comparatively poor waterproof effect. In the illustrated embodiment, the housing 4 advantageously performs sheathing from the front end of the illuminating body 1. First, the inner wall of the housing 4 abuts against the outer wall of a portion of the illuminating body 1, and the outer wall of the illuminating body 1 is generally arranged according to specifications, and is comparatively smooth. Second, the inner wall of the housing 4 is fastened to the outer wall of the isolation fixing column 3, and the combination of the above-mentioned structures can greatly improve the waterproof effect.

The housing 4 may be installed in a front-to-rear manner, making it possible for the housing 4 to be installed after the illuminating body 1 is directly connected with the wires 2 and the like, while the traditional installation manner of achieving waterproofing by making the housing 4 abut against the rear end of the illuminating body 1 can only firstly make the housing 4 sheath the wires 2 and then install the illuminating body 1, which has a low production efficiency and can hardly achieve automated production. The above-mentioned structure and installation manner, in which the housing 4 performs sheathing from the front end of the illuminating body 1, can improve the production efficiency and facilitate the achievement of the automated production. In addition, the housing 4 is not affected by the number and size of the wires 2, and the housing 4 can improve the waterproof reliability and reduce the production cost by fastening the outer wall of the isolation fixing column 3 to the inner wall of the housing 4.

In order to provide a comparatively good decorative effect, a decorative lamp cover or the like may be placed on the periphery of the illuminating body 1.

As an optional implementation mode, the illuminating body 1 is an LED or a tungsten filament lamp or a functional LED.

The illuminating body 1 is gradually widened from the front end to the rear end, and in order to make the housing 4 closely cooperate with the illuminating body 1, as an optional implementation mode, the front end face cavity of the housing 4 is adapted to the shape of the illuminating body 1, and the inner diameter of the housing 4 is gradually widened from one end to the other end.

It is convenient for the housing 4 of the above-mentioned structure to perform sheathing from the narrower end to the wider end of the illuminating body 1, and as the housing 4 gradually performs sheathing, the outer wall of the illuminating body 1 abuts against the inner wall of the housing 4 and is fastened thereto.

With reference to FIG. 2, a resistor 5 may be connected (e.g., by welding, soldering, or otherwise) to the illuminating body 1. The wires 2 are connected to the pins of the illuminating body 1, in addition to the joint of the wires 2 and the illuminating body 1, the exteriors of the wires 2 will be generally provided with insulating sleeves, which results in that the outer diameters of the wires 2 are larger than the outer diameter of the joint after the provision of the insulating sleeves. In order to adapt to the above-mentioned structure of the wires 2, as an optional implementation mode, referring to FIG. 3 and FIG. 4, the isolation fixing column 3 may include a first clamping end 301 and a second clamping end 302, the first clamping end 301 having a smaller diameter than the second clamping end 302. The first clamping end 301 is clamped at a joint of the wires 2 and the illuminating body 1, and the second clamping end 302 is clamped between the insulating sleeves of the wires 2. The housing 4 includes a first step 401 and a second step 402. When the housing 4 sheaths the periphery of the isolation fixing column 3, the inner wall of the first step 401 is fastened to the outer wall of the first clamping end 301, and the inner wall of the second step 402 is fastened to the outer wall of the second clamping end 302.

The above-mentioned structure of the isolation fixing column 3 is more suitable for the structure of the wires 2, and can be better clamped between the wires 2, meanwhile the first step 401 and the second step 402 of the housing 4 correspond to the arrangement of the isolation fixing column 3, and the mutual cooperation of the two parts can ensure that the outer wall of the isolation fixing column 3 and the inner wall of the housing 4 fasten the wires 2 and better prevent entry of water.

In the above-mentioned preferred embodiments, referring to FIG. 3 specifically, the structure that provides the waterproof effect is mainly as follows: the housing 4 is fastened to the outer wall of the rear end portion of the illuminating body 1, the second step 402 of the housing 4 is fastened to the second clamping end 302 of the isolation fixing column 3, and the above-mentioned structure is beneficial to the waterproof effect.

Figure 4:
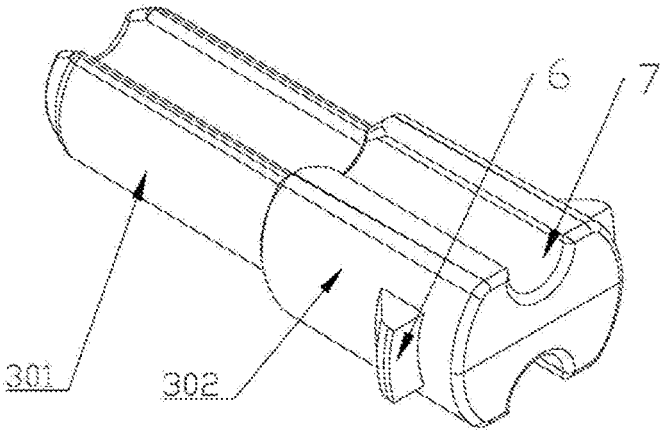
FIG. 4 is a perspective view of the structure of the isolation fixing column.
Figure 5:
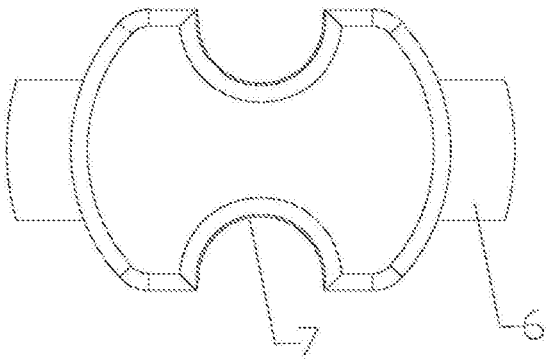
FIG. 5 is an end view illustrating a rear end face of the isolation fixing column.

In order to better fix the wires 2, as an optional implementation mode, referring to FIG. 4 and FIG. 5, the outer wall of the isolation fixing column 3 is provided with a first arcuate groove 7, the inner wall of the housing 4 is provided with a second arcuate groove 8, the first arcuate groove 7 corresponds to the second arcuate groove 8, and the wire 2 is clamped between the first arcuate groove 7 and the second arcuate groove 8.

The first arcuate groove 7 and the second arcuate groove 8 both can be set to semicircle-shaped arcuate grooves, and the wire 2 is clamped between the above-mentioned two arcuate grooves to ensure the fixing effect without damaging the wire 2. The number of the first arcuate grooves 7 may be determined in accordance with the number of the wires 2, and as compared with the traditional manner of providing the through holes in the housing 4, the above-mentioned structure, where the wires 2 do not need to entirely pass through the through holes of the housing 4, is not subject to the number and size of the wires 2.

Figure 6:
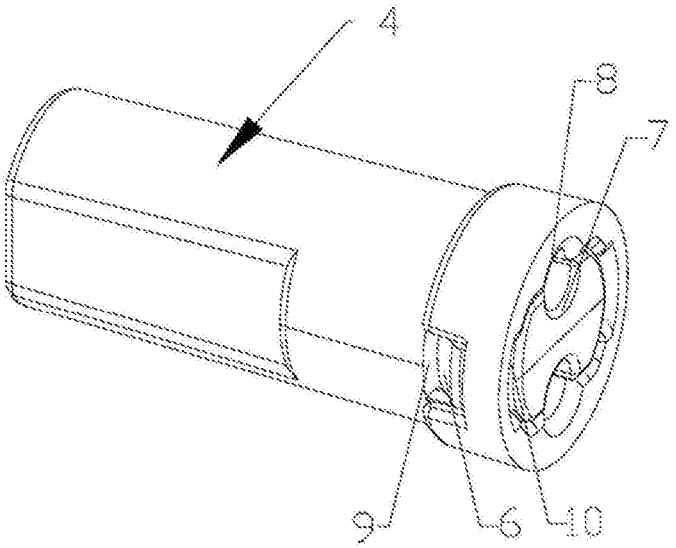
FIG. 6 is a perspective view of installation of a housing in cooperation with the isolation fixing column.
Figure 7:
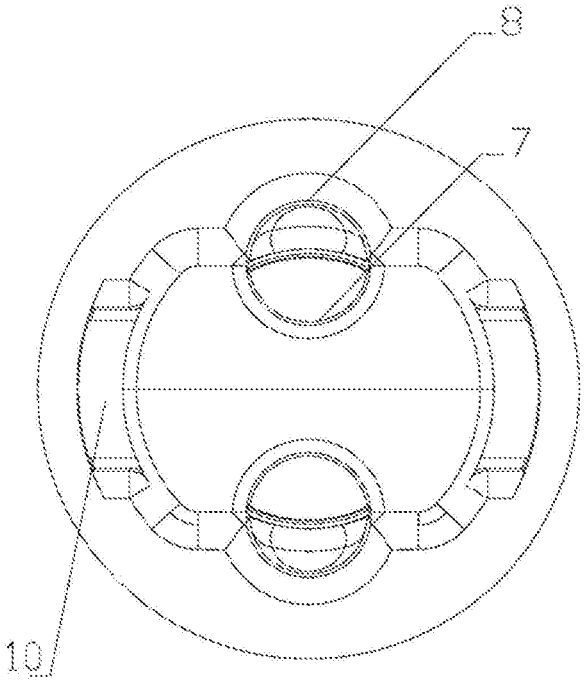
FIG. 7 is an end view illustrating the rear end face of the housing cooperating with the isolation fixing column.

In order to prevent the housing 4 or the isolation fixing column 3 from moving up and down, as an optional implementation mode, referring to FIGS. 4-7, where FIG. 6 is a schematic view of installation of a housing in cooperation with the isolation fixing column, and FIG. 7 is a schematic view of the rear end face of the housing cooperating with the isolation fixing column, the outer wall of the second clamping end 302 is provided with a buckle block 6. The housing 4 further includes a third step 403 connected with the second step 402, and the third step 403 is provided with an installation hole 9 at a joint between the third step 403 and the second step 402. The buckle block 6 can be engaged in the installation hole 9 when the housing 4 sheaths the periphery of the isolation fixing column 3.

As for a traditional waterproof decorative lamp, after the wires 2 pass through the housing 4, the housing 4 can be pulled back and forth and cannot be fixed, and the waterproof effect is also reduced. In the exemplary embodiments of the present invention described and illustrated herein, the housing 4 and the isolation fixing column 3 are fixed in an engaged manner (e.g., a snap-fit), so that the fastening structure can be ensured and the waterproof effect can be ensured.

As an optional implementation mode, referring to FIG. 6 and FIG. 7, the bottom end face of the third step 403 is provided with a notch 10, and the front end face of the buckle block 6 is an oblique face, so that the buckle block 6 enters the installation hole 9 through the notch 10.

In order to ensure the fastening effect of the buckle block 6, as an optional implementation mode, referring to FIG. 3 and FIG. 7, the front edge of the installation hole 9 is connected with the second step 402, and when the buckle block 6 is engaged in the installation hole 9, the rear side wall of the installation hole 9 abuts against the rear end face of the buckle block 6, and the front end of the oblique face is engaged at a joint of the second step 402 and the third step 403.

It is convenient for the oblique face to enter the cavity of the housing 4 from the notch 10, since the third step 403 is provided with the installation hole 9, the outer wall of the third step 403 protrudes from the outer wall of the second step 402, when the buckle block 6 is engaged in the installation hole 9, the front end of the buckle block 6 can abut against the joint of the second step 402 and the third step 403, the rear side wall of the installation 9 abuts against the rear end face of the buckle block 6, and the arrangement of the installation hole 9 fixes the buckle block 6 by front and rear clamping.

As an optional implementation mode, the number of the wires 2 is two or more in some embodiments, or only two in some embodiments.

An implementation mode having two wires is provided in the figures of the invention, and specifically, as an optional implementation mode, referring to FIG. 1, FIG. 2 and FIG. 4, the isolation fixing column 3 comprises a first group of side faces and a second group of side faces, the first group of side faces and the second group of side faces both include two side faces, the two side faces of the first group of side faces are oppositely disposed, the two side faces of the second group of side faces are oppositely disposed, the two side faces of the first group of side faces are both provided with the first arcuate grooves 7, and the two side faces of the second group of side faces are both provided with the buckle blocks 6.

Referring to FIG. 1 and FIG. 2, by taking a decorative lamp having two wires as an example, the number of the wires of the decorative lamp is generally set to two, during the use of the waterproof decorative lamp of the above-mentioned structure, after the wires 2 are welded and fixed to the illuminating body 1, the isolation fixing column 3 is clamped between the two wires 2, and specifically, the wire 2 is clamped between the first arcuate groove 7 and the second arcuate groove 8; then the housing 4 performs sheathing from the front end of the illuminating body 1 until the inner wall of the housing 4 is fastened to the outer wall of the rear portion of the illuminating body 1, the inner wall of the housing 4 is fastened to the outer wall of the isolation fixing column 3, and the above-mentioned structure can provide a comparatively good waterproof effect.

It should be understood that when the number of the wires changes, the number of the first arcuate grooves 7 and the second arcuate grooves 8 may be changed, and proper positions may be adjusted according to actual conditions; when the diameter of the wire 2 changes, since the first arcuate groove 7 and the second arcuate groove 8 are spliced to clamp the wire 2, rather than that a through hole with a fixed hole diameter clamps the wire 2, the above-mentioned splicing manner can be adapted to wires of different sizes.

Although the invention has been described in detail with reference to certain preferred embodiments, variations and modifications exist within the scope and spirit of one or more independent aspects of the invention as described.

Various features of the invention are set forth in the following claims.

What is claimed is:

1. A decorative lamp comprising:

an illuminating body having a first end and a second end opposite the first end;

first and second wires coupled to the first end of the illuminating body;

an isolation fixing column disposed adjacent the first end of the illuminating body and having a first end and a second end with the second end of the isolation fixing column adjacent the first end of the illuminating body, the isolation fixing column including a first portion extending from the first end and having a first cross-section, a second portion extending from the first portion and having a second cross-section different from the first cross-section, a first groove having a first portion extending along an outer surface of the first portion of the isolation fixing column and a second portion extending along an outer surface of the second portion of the isolation fixing column, wherein the first groove extends from the first end of the illuminating body to the first end of the isolation fixing column and is configured to receive the first wire, a second groove having a first portion extending along the outer surface of the first portion of the isolation fixing column and a second portion extending along the outer surface of the second portion of the isolation fixing column, wherein the second groove extends from the first end of the illuminating body to the first end of the isolation fixing column and is configured to receive the second wire, wherein the isolation fixing column includes a step between the first portion and the second portion of the first groove and between the first portion and the second portion of the second groove; and a housing enclosing the first end of the illuminating body and at least a portion of the isolation fixing column, wherein a third groove extends along an inner surface of the housing and is aligned with the first groove to form a track configured to receive the first wire, and a fourth groove extends along the inner surface of the housing and is aligned with the second groove to form a track configured to receive the second wire, wherein each of the tracks extends from the first end of the housing, and wherein the first wire and the second wire are clamped between the housing and the isolation fixing column.

2. The decorative lamp of claim 1, wherein the housing has a first end and a second end opposite the first end, and wherein the illuminating body is configured such that a portion of the illuminating body is positioned at least partially within the housing with a portion of the illuminating body extending through the second end of the housing, and wherein the housing is configured such that the second end of the illuminating body is installed through the first end of the housing.

3. The decorative lamp of claim 1, wherein the isolation fixing column comprises a one-piece structure.

4. The decorative lamp of claim 1, wherein the isolation fixing column is fixed to the housing.

5. The decorative lamp according to claim 1, wherein the second end of the isolation fixing column has a smaller cross-section than the cross-section of the first end of the isolation fixing column.

6. A decorative lamp comprising:

a housing including a first end, a second end opposite the first end, a through hole extending through the first and second ends of the housing, and a first plurality of grooves formed in an inner surface of the housing and extending from the first end of the housing;

an illuminating body having a first end and a second end opposite the first end, wherein the illuminating body is configured such that the first end of the illuminating body is positioned within the housing, and wherein the housing is configured such that the second end of the illuminating body is installed through the first end of the housing;

a plurality of wires coupled to the first end of the illuminating body; and an isolation fixing column having a first end and a second end opposite the first end, the isolation fixing column positioned between the plurality of wires with the second end of the isolation fixing column disposed adjacent the first end of the illuminating body, the isolation fixing column having a second plurality of grooves, wherein the second end of the isolation fixing column abuts the first end of the illuminating body, wherein the second plurality of grooves extends from a first end of the illuminating body along an outer surface of the isolation fixing column from the first end of the illuminating body to the first end of the isolation fixing column, and wherein a first portion of the second plurality of grooves extends from a first end of the illuminating body and a second portion of the second plurality of grooves extends from a first end of the housing to the first portion of the second plurality of grooves, with the first portion of the second plurality of grooves offset in a radial direction from the second portion of the second plurality of grooves, wherein the outer surface of the isolation fixing column abuts the inner surface of the housing, and the first plurality of grooves and the second plurality of grooves are aligned to form a plurality of tracks extending from the first end of the housing, and wherein each one of the plurality of tracks is configured to receive one of the wires of the plurality of wires coupled to the illuminating body.

7. The decorative lamp of claim 6, wherein the isolation fixing column comprises a one-piece structure.

8. The decorative lamp of claim 6 further comprising a buckle block projecting from a side of the isolation fixing column, wherein the housing includes an installation hole configured to receive the buckle block to couple the housing to the isolation fixing column.

9. The decorative lamp of claim 6, wherein an outer surface of the housing includes a stepped structure.

10. The decorative lamp of claim 6, wherein the illuminating body includes a plurality of pins corresponding to the plurality of wires, wherein the plurality of pins is positioned to be received in the second plurality of grooves.

11. The decorative lamp of claim 6, wherein the isolation fixing column is fixed to the housing.

12. The decorative lamp of claim 6, wherein the second end of the isolation fixing column has a smaller cross-section than a cross-section of the first end of the isolation fixing column.

* * * * *